United States Patent [19]

Nitta

[11] Patent Number: 4,784,602

[45] Date of Patent: Nov. 15, 1988

[54] GAS LIGHTER EQUIPPED WITH A SAFETY LOCK

[75] Inventor: Tomio Nitta, Kanagawa, Japan

[73] Assignee: Tokai Corporation, Kanagawa, Japan

[21] Appl. No.: 146,157

[22] Filed: Jan. 20, 1988

[30] Foreign Application Priority Data

Mar. 9, 1987 [JP] Japan ..... 62-33124[U]

[51] Int. Cl.[4] ..... F23D 11/36

[52] U.S. Cl. ..... 431/153; 431/277; 222/153; 222/402.11; 251/95; 251/106

[58] Field of Search ..... 251/95, 319, 102, 105, 251/106; 431/255, 277, 267, 131, 153, 253; 222/153, 402.11, 384

[56] References Cited

U.S. PATENT DOCUMENTS

| | | | |
|---|---|---|---|
| 3,006,340 | 10/1961 | Meshberg | 222/402.11 X |
| 3,721,423 | 3/1973 | Shay | 222/402.11 X |
| 3,938,943 | 2/1976 | Malamoud | 431/150 |
| 4,432,542 | 2/1984 | Poynter | 431/254 X |

FOREIGN PATENT DOCUMENTS

| | | | |
|---|---|---|---|
| 978503 | 11/1975 | Canada | 222/402.11 |

*Primary Examiner*—Randall L. Green

*Attorney, Agent, or Firm*—Armstrong, Nikaido, Marmelstein & Kubovcik

[57] ABSTRACT

Disclosed is a gas lighter equipped with a safety lock, which is an L-shaped slidable stopper so slidably fitted in the re-entrancy of the thumb-push gas lever that its vertical pin may be above a hole of the lighter housing when its horizontal slide is pushed in the re-entrancy of the gas lever, thus permitting the descent of the gas lever for lighting, and that its vertical pin may be off from the hole of the surface of the lighter housing when its horizontal slide is drawn backward, thus preventing the descent of the gas lever for lighting. A gas lighter according to the persent invention assures in its locking condition that an accident which may be caused when a child plays with the device, such as a burn or an accidental fire is prevented.

3 Claims, 1 Drawing Sheet

GAS LIGHTER EQUIPPED WITH A SAFETY LOCK

BACKGROUND OF THE INVENTION

1. Field of the Invention

The present invention relates to a gas lighter equipped with a safety lock.

2. Related Arts

A conventional gas lighter is operated by pushing down its gas lever for ejecting gas and at the same time by rotating its striker wheel for striking fire and igniting the ejected gas, thereby permitting a small flame to shoot out. Such gas lighter is very easy to handle, and even a child can use the device. Therefore, there is a fear of a child getting burnt while playing with a gas lighter, and also there is a fear of a fire breaking out.

SUMMARY OF THE INVENTION

The object of the present invention is to provide a gas lighter equipped with a safety lock, thereby guaranteed free of such fears as described above.

The present invention is an improvement of a gas lighter which comprises a housing having a gas well contained therein, a gas valve fixed to the inside of the housing and communicating with the gas well, a gas ejection nozzle connected to the gas valve and fixed to the top of the housing, a fire-striking wheel rotatably fixed to the top of the housing in the vicinity of the gas ejection nozzle, a thumb-operated gas lever movably fixed to the top of the housing in the vicinity of the fire-striking wheel and operatively connected to the gas valve, the thumb-operated gas lever being responsive to thumb-push for descending and opening the valve, thereby permitting the ejection of gas from the gas ejection nozzle, and a windshield fixed to the top of the housing and surrounding the gas ejection nozzle.

To attain the above object, such gas lighter is improved according to the present invention in that: there is provided a safety lock in the form of slidable stopper, which is composed of a horizontal slide slidably connected to the gas lever and a vertical pin integrally connected to and extending downward from the horizontal slidee, the top of the housing having a hole made in such a position that the vertical pin may be permitted to enter the hole when the slide is brought in a push-in working position, thus permitting the descent of the gas lever to light, the vertical pin being prevented from descending to light when the slide is brought in a position other than the push-in working position.

Other objects and advantages of the present invention will be better understood from the following description of a gas lighter according to one embodiment of the present invention, which is shown in the accompanying drawings:

PREFERRED EMBODIMENT OF THE INVENTION

Figure 1:
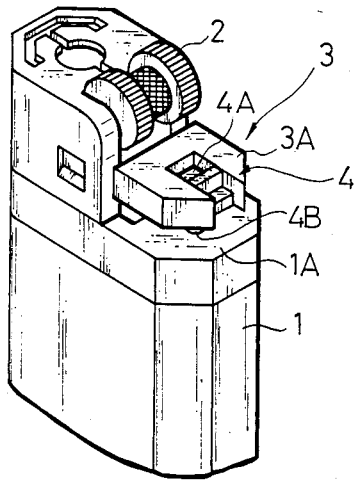
FIG. 1 is a perspective view of a gas lighter equipped with a safety lock according to the present invention.
Figure 5:
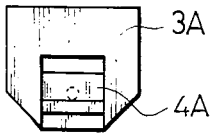
FIG. 5 is a plan view of the slidable stopper in its locking condition.
Figure 4:
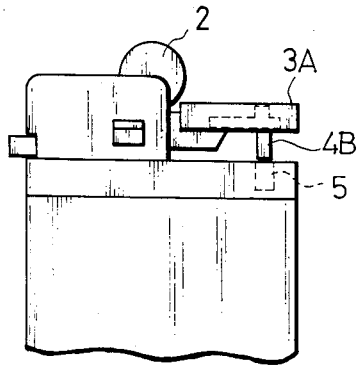
FIG. 4 is a side view of the gas lighter in its unlocking condition.
Figure 6:
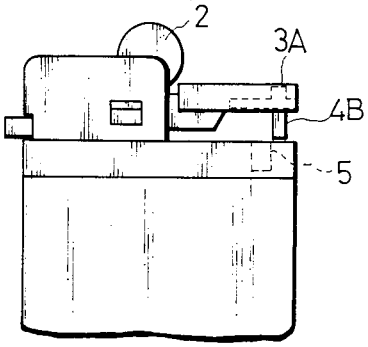
FIG. 6 is a side view of the gas lighter in its locking condition.

Referring to the drawings, a gas lighter comprises a housing 1 which contains a gas well, a gas valve communicating with the gas well and other necessary parts. A gas ejection nozzle (not shown) is connected to the gas valve and fixed to the top of the housing 1. A fire-striking wheel 2 is rotatably fixed to the top of the housing 1 in the vicinity of the gas ejection nozzle. A thumb-operated gas lever 3 is movably fixed to the top of the housing 1 in the vicinity of the fire-striking wheel 2. One end of the gas lever 3 is connected to the gas valve for permitting the ejection of gas from the gas ejection nozzle, and the other end of the gas lever 3 is made in the form of thumb-push piece 3A. The thumb-operated gas lever 3 is responsive to thumb-push for descending and opening the gas valve, thereby permitting the ejection of gas from the gas ejection nozzle. A windshield is fixed to the top of the housing 1 to surround the gas ejection nozzle. A slidable stopper 4 is attached to the thumb-push piece 3A. The horizontal slide 4A of the stopper 4 is slidably connected to the thumb-push piece 3A of the gas lever 3, and the vertical pin 4B of the stopper 4 is just above the hole 5 of the housing 1 when the slider 4A is put in an inward or push-in working position (See FIGS. 1, 2 and 4). The vertical pin 4B of the stopper 4 is off from the hole 5 of the housing 1 when the slide 4A is put in a position other then the push-in working position (See FIGS. 5 and 6).

Figure 2:
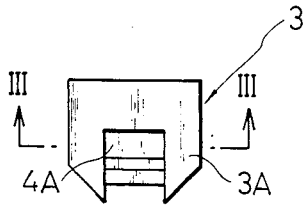
FIG. 2 is a plan view of the slidable in its unlocking condition.
Figure 3:
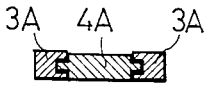
FIG. 3 is a cross section of the slidable stopper taken along the line III—III and as seen from the direction indicated by arrows in FIG. 2.

As best shown in FIG. 2, the thumb-push piece 3A has reentrancy opening outward on the side of gas lever opposite to the windshield. As best shown in FIG. 3, the opposite extentions of the thumb-push lever 3A has slots made on its opposing side walls. The slide 4A of the stopper 4 has ridges on its opposite edges, and is slidably fitted in the re-entrancy of the gas lever with the ridges of the opposite slide edges inserted in the slots of the re-entrancy. Alternatively, the re-entrancy the windshield. As best shown in FIG. 3, the opposite extensions of the thumb-push lever 3A has slots made on its opposing side walls. The slide 4A of the stopper 4 has ridges on its opposite edges, and is slidably fitted in the re-entrancy of the gas lever with the ridges of the opposite slide edges inserted in the slots of the re-entrancy. Alternatively, the re-entrancy may have ridges on its opposing side walls, and the slide 4A of the stopper may have slots made on its opposite edges.

With this arrangement the vertical pin 4B of the stopper 4 is above the hole 5 of the housing 1 when the stopper 4 is pushed in the re-entrancy of the gas lever, thus preventing the descent of the gas lever to light. The vertical pin 4B of the stopper 4 is off from the hole 5 of the top surface of the housing 1 when the stopper is drawn backward, thus preventing the descent of the gas lever to light.

As may be understood from the above, a gas lighter according to the present invention assures in its locking condition that an accident which may be caused when a child plays with the device, such as a burn or and accidental fire is prevented.

What is claimed is:

1. A gas lighter comprising a housing having a gas well contained therein, a gas valve fixed to the inside of the housing and communicating with the gas well, a gas ejection nozzle connected to the gas valve and fixed to the top of the housing, a fire-striking wheel rotatably fixed to the top of the housing in the vicinity of the gas ejection nozzle, a thumb-operated gas lever movably fixed to the top of the housing in the vicinity of the fire-striking wheel and operatively connected to the gas valve, the thumb-operated gas lever being responsive to thumb-push for descending and opening the valve, thereby permitting the ejection of gas from the gas ejection nozzle, and a windshield fixed to the top of the housing and surrounding the gas ejection nozzle, characterized in that the gas lighter further comprises a stopper which is composed of a horizontal slide slidably connected to the gas lever and a vertical pin integrally connected to and extending downward from the horizontal slide, the top of the housing having a hole made in such a position that the vertical pin may be permitted to enter the hole when the slide is brought in the push-in working position, thus permitting the descent of the gas lever for lighting, the vertical pin being prevented from descending for lighting when the slide is brought in a position other than the push-in working position.

2. A gas lighter as claimed in claim 1, wherein the thumb-operated gas lever has a re-entrancy opening on the side of the gas lever opposite to the windshield, the re-entrancy opening having slots made on its opposing side walls and the slide having ridges on its opposite edges, and being slidably fitted in the re-entrancy opening of the gas lever with the ridges of the opposite edges inserted in the slots of the re-entrancy opening.

3. A gas lighter as claimed in claim 1, wherein the thumb-operated gas lever has a re-entrancy opening on the side of the gas lever opposite to the windshield, the re-entrancy opening having ridges on its opposing side walls and the horizontal slide has slots made on its opposite edges, said slide being fitted in the re-entrancy opening of the gas lever with the ridges of the opposing side walls of the re-entrancy opening inserted in the slots of the slide.

* * * * *